US009318797B2

(12) United States Patent
Tseng et al.

(10) Patent No.: US 9,318,797 B2
(45) Date of Patent: Apr. 19, 2016

(54) ELECTRONIC DEVICE

(71) Applicants: Bin-Chyi Tseng, Taipei (TW); Tsung-Chieh Yen, Taipei (TW); Chih-Chung Lin, Taipei (TW)

(72) Inventors: Bin-Chyi Tseng, Taipei (TW); Tsung-Chieh Yen, Taipei (TW); Chih-Chung Lin, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 191 days.

(21) Appl. No.: 14/277,065

(22) Filed: May 14, 2014

(65) Prior Publication Data

US 2014/0347228 A1 Nov. 27, 2014

Related U.S. Application Data

(60) Provisional application No. 61/826,988, filed on May 23, 2013.

(30) Foreign Application Priority Data

Feb. 12, 2014 (CN) ..... 2014 1 0048864

(51) Int. Cl.
*H01Q 1/24* (2006.01)
*H01Q 1/44* (2006.01)

(52) U.S. Cl.
CPC ..... *H01Q 1/245* (2013.01); *H01Q 1/24* (2013.01); *H01Q 1/241* (2013.01); *H01Q 1/242* (2013.01); *H01Q 1/44* (2013.01)

(58) Field of Classification Search
CPC ..... H01Q 1/24; H01Q 1/241; H01Q 1/242; H01Q 1/245; H01Q 1/44
USPC ..... 343/702, 787
See application file for complete search history.

(56) References Cited

U.S. PATENT DOCUMENTS

| | | | | |
|---|---|---|---|---|
| 8,193,992 | B2 * | 6/2012 | Ikonen | H01Q 1/243 343/702 |
| 8,725,222 | B2 * | 5/2014 | Phillips | G06K 19/005 455/556.1 |
| 9,083,073 | B2 * | 7/2015 | Yang | H01Q 1/22 |
| 2012/0075148 | A1 | 3/2012 | Cho | |
| 2014/0080411 | A1 * | 3/2014 | Konanur | H04B 5/0031 455/41.1 |
| 2014/0111387 | A1 * | 4/2014 | Konanur | H01Q 1/243 343/702 |

FOREIGN PATENT DOCUMENTS

| | | |
|---|---|---|
| CN | 201957086 | 8/2011 |

* cited by examiner

*Primary Examiner* — Hoang V Nguyen
(74) *Attorney, Agent, or Firm* — Jianq Chyun IP Office

(57) ABSTRACT

An electronic device includes a main body, a metal cover, an antenna and a magnetic flux inducer unit. The metal cover is disposed at the main body and the main body includes a nonmetal covered portion. The antenna is disposed in the main body. The magnetic flux inducer unit is disposed in the main body and located between the nonmetal covered portion and the antenna. The permeability of the magnetic flux inducer unit is greater than 1.

9 Claims, 3 Drawing Sheets

ELECTRONIC DEVICE

CROSS-REFERENCE TO RELATED APPLICATION

This application claims the priority benefits of U.S. provisional application Ser. No. 61/826,988, filed on May 23, 2013 and China application serial no. 201410048864.0, filed on Feb. 12, 2014. The entirety of each of the above-mentioned patent applications is hereby incorporated by reference herein and made a part of this specification.

BACKGROUND OF THE INVENTION

1. Field of the Invention

The invention relates to an electronic device and, more particularly, to an electronic device having an antenna.

2. Description of the Related Art

As technology develops, electronic communication devices (such as mobile telephones, tablet computers) are widely used. Recent years, except for the functionality, the requirement of the product appearance is higher. Thus, a metal cover is usually used in the electronic device. However, the external magnetic flux is shielded by the metal cover, which affects the electromagnetic induction of the antenna in the electronic device.

BRIEF SUMMARY OF THE INVENTION

An electronic device is provided. The electronic device includes a complete metal cover and an antenna with a good magnetic field induction effect.

An electronic device including a main body, a metal cover, an antenna and a magnetic flux inducer unit is provided. The metal cover is disposed at the main body, and the main body includes a nonmetal covered portion. The antenna is disposed in the main body. The magnetic flux inducer unit is disposed in the main body and located between the nonmetal covered portion and the antenna. The magnetic permeability of the magnetic flux inducer unit is greater than 1.

The electronic device in the disclosure induces an enough external magnetic flux into the antenna in the electronic device via the magnetic flux inducer unit with high permeability through disposing the magnetic flux inducer unit between the original nonmetal covered portion of the metal cover (such as the opening of a camera lens or the opening of a logo) and the antenna, or disposing the magnetic flux inducer unit between the nonmetal frame close to the metal cover and the antenna, so as to prevent the metal cover having a shielding effect to the antenna. The electronic device in the disclosure keeps a complete metal cover and a good product appearance.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

An electronic device, such as a mobile telephone or a tablet computer, usually includes a camera lens disposed outward, so as to capture an image. Therefore, an opening covered by a nonmetal material is formed at a cover of the electronic device corresponding to the camera lens, or the opening is covered by a nonmetal cover with a logo, such as a trademark or a model number. In an embodiment, the original nonmetal cover cooperates with a magnetic flux inducer unit to induce an enough external magnetic flux to the antenna in the electronic device, consequently, the antenna in the electronic device can still have effective electromagnetic induction under the configuration of the complete metal cover, and the shielding effect of the complete metal cover to the antenna is reduced.

Figure 1:
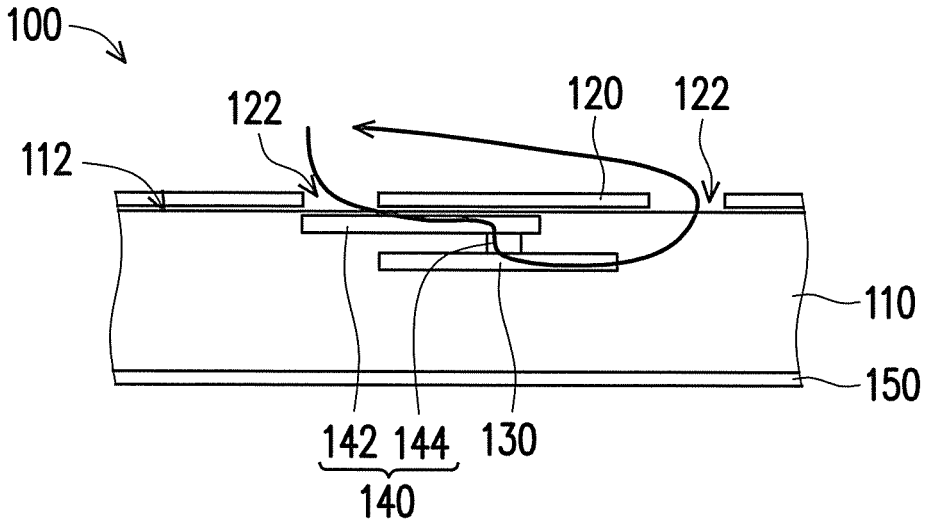
FIG. 1 is a side view showing partial of an electronic device in the first embodiment.

FIG. 1 is a side view showing partial of an electronic device in the first embodiment. Please refer to FIG. 1, in the embodiment, an electronic device 100 is a mobile phone only including a single main body. In other embodiment, the electronic device 100 may be a tablet computer, a flip mobile phone including two main bodies, which is not limited herein. In FIG. 1, the components, such as a circuit board, controllers, and parts of the casings, which are hidden in the electronic device 100 are not shown for a clear figure.

In the embodiment, the electronic device 100 includes a main body 110, a metal cover 120, an antenna 130 and a magnetic flux inducer unit 140. The main body 110 includes a first side 112 opposite to a display panel 150, and the metal cover 120 is entirely disposed at the first side 112 of the main body 110 and includes a nonmetal covered portion 122. The position of the nonmetal covered portion 122 is corresponding to the position of a camera lens (not shown), or the position of the nonmetal covered portion 122 is the position of a specific logo or pattern, as long as the position is located at the nonmetal covered portion of the metal cover 120 for requirement, the type of the nonmetal covered portion 122 is not limited herein. The antenna 130 is disposed in the main body 110. In the embodiment, the antenna 130 is a near field antenna, which is not limited herein.

The magnetic flux inducer unit 140 is disposed in the main body 110 and located between the nonmetal covered portion 122 and the antenna 130. In the embodiment, the material of the magnetic flux inducer unit 140 may be an iron, nickel, Mn—Zn ferrite, Ni—Zn ferrite, Ni—Fe ferrite, Ni—Cu—Zn ferrite, which is not limited herein, as long as the magnetic permeability of the magnetic flux inducer unit 140 is greater than 1.

As shown in FIG. 1, in the embodiment, the magnetic flux inducer unit 140 includes a board 142 and a pillar 144 extending from the position close to the edge of the board 142. In FIG. 1, the magnetic flux inducer unit 140 is approximately an L-shaped, which is not limited herein. In the embodiment, the pillar 144 of the magnetic flux inducer unit 140 contacts with the antenna 130, in other embodiment, the magnetic flux inducer unit 140 and the antenna 130 may be separated by a small gap, as long as the magnetic flux inducer unit 140 induces an enough external magnetic flux to the antenna 130.

In the embodiment, since there is a distance between the projection of the antenna 130 on the metal cover 120 and the position of the nonmetal covered portion 122 of the metal cover 120, the external magnetic fluxis shielded by the metal cover 120, which makes the antenna 130 can't generate the electromagnetic induction. However, via the magnetic flux inducer unit 140 with high magnetic permeability extending from the nonmetal covered portion 122 to the antenna 130 of the electronic device 100, the magnetic flux inducer unit 140 can induce an enough external magnetic flux from the nonmetal covered portion 122 to the electronic device 100, and then induce into the antenna 130. Moreover, the induced magnetic flux passing through the antenna 130 can leave the electronic device 100 from the nonmetal covered portion 122 to form a closed loop, and then the antenna 130 generates the effective electromagnetic induction. The induced current is generated by the electromagnetic induction to enable the near field communication chip, and then the near field communication chip can executes data transmission and data exchange. Therefore, the affection due to the complete metal cover 120 can be reduced by disposing the magnetic flux inducer unit 140 between the nonmetal covered portion 122 and the antenna 130.

In the embodiment, the electronic device 100 keeps the complete metal cover 120 and a good product appearance via the above configuration, and it can also reduce the shielding effect to the antenna 130 in the electronic device 100 by the magnetic shielding of the metal cover 120, and thus it can achieve good communication.

In the embodiment, the magnetic flux be induced into and leave out of the electronic device 100 via different nonmetal covered portions 122. In other embodiment, the magnetic flux can be induced into and leave out of the electronic device 100 via the same nonmetal covered portion 122. Or the magnetic flux inducer unit 140 can be disposed at another nonmetal covered portion for the magnetic flux passing through, and then the magnetic flux can be induced into and leave out of the electronic device 100 from other portions of the electronic device 100.

Figure 2A:
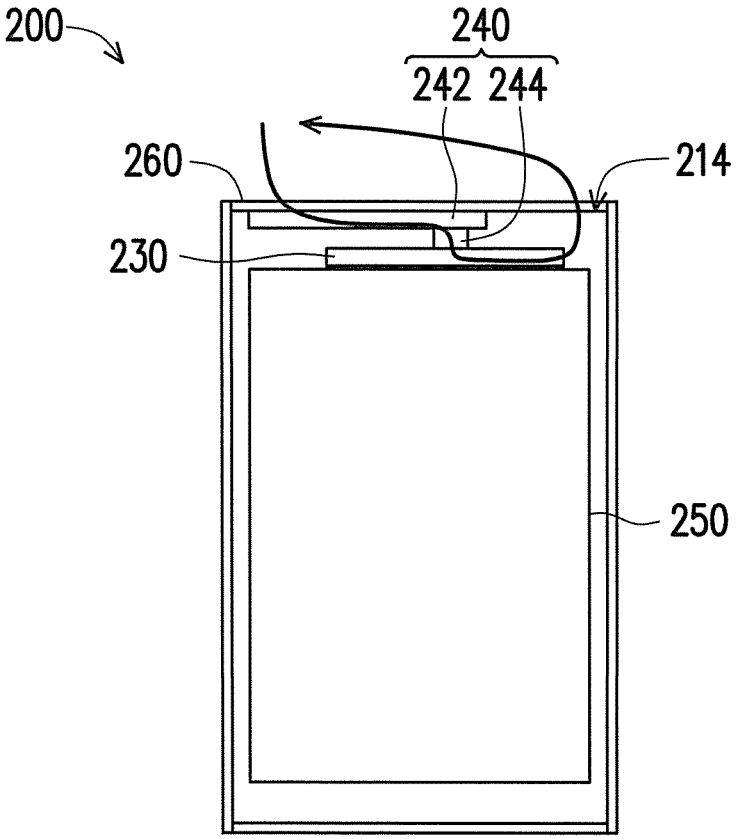
FIG. 2A is a back view showing an electronic device in the second embodiment.
Figure 2B:
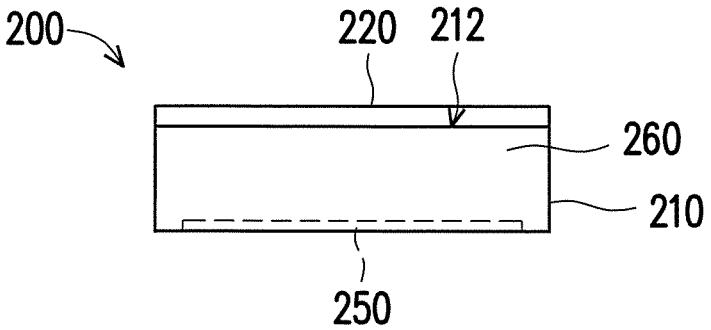
FIG. 2B is a top view showing the electronic device in FIG. 2A.

FIG. 2A is a back view showing an electronic device in a second embodiment, FIG. 2B is a top view showing the electronic device in FIG. 2A. Please refer to FIG. 2A and FIG. 2B. The main difference between the electronic device 200 in FIG. 2A and the electronic device 100 in FIG. 1 is that the magnetic flux in FIG. 1 be induced into and leave out of the electronic device 100 via the nonmetal covered portion 122 of the metal cover 120, and the magnetic flux inducer unit 140 is disposed between the nonmetal covered portion 122 and the antenna 130, in FIG. 2A, in the embodiment, the electronic device 200 further includes a nonmetal material frame 260. The magnetic flux be induced into and leave out of the electronic device 200 via the nonmetal material frame 260, and the magnetic flux inducer unit 240 is disposed between the nonmetal material frame 260 and the antenna 230.

In detail, in the embodiment, the main body 210 includes a first side 212 and a second side 214 adjacent to each other. The first side 212 is opposite to a display panel 250, the second side 214 is one of the sides which connect the first side 212 and the side for disposing a display panel 250. The metal cover 220 is entirely disposed at the first side 212, and the nonmetal material frame 260 is disposed at the second side 214. In the embodiment, the material of the nonmetal material frame 260 is plastics, which is not limited herein, as long as the material allows the magnetic flux to pass through. The antenna 230 is located in the main body 210, in the embodiment, the antenna 230 is a near field antenna, which is not limited herein. The magnetic flux inducer unit 240 is disposed in the main body 210 and located between the nonmetal material frame 260 and the antenna 230. The magnetic flux inducer unit 240 includes a board 242 and a pillar 244. The board 242 extends form the position close to the nonmetal material frame 260 to the position close to the antenna 230, the pillar 244 extends form the position close to the edge of the board 242 and contacts with the antenna 230.

In the embodiment, although the antenna 230 towards the direction of the first side 212 is shielded by the metal cover 220, which is difficult to receive the external magnetic flux, the external magnetic flux can be induced into the electronic device 200 from the nonmetal material frame 260 disposed at the second side 214 and then are induced into the antenna 230 via the magnetic flux inducer unit 240 with high magnetic permeability. Thus, the antenna 230 generates the effective electromagnetic induction, so as to solve the problem that the antenna 230 is affected by the complete metal cover 220.

Figure 3A:
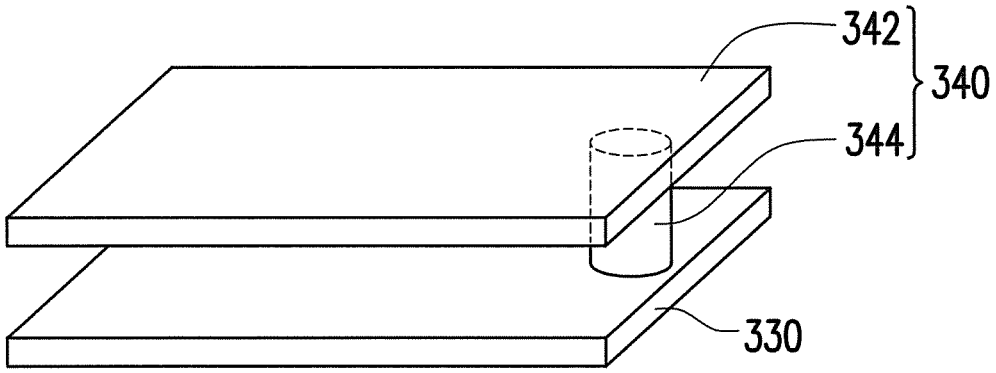
FIG. 3A is a schematic diagram showing a magnetic flux inducer unit and an antenna of an electronic device in the third embodiment.

In the embodiments, the pillar 144 of the magnetic flux inducer unit 140 and the pillar 244 of the magnetic flux inducer unit 240 contact with the central positions of the antenna 130, 230, respectively. In other embodiment, the magnetic flux inducer unit 140, 240 and the antenna 130, 230 are separated by a small gap, respectively, as long as the magnetic flux inducer unit 140, 240 can induce the external magnetic flux to the antenna 130, 230. The relative positions of the magnetic flux inducer unit 140, 240 and the antenna 130, 230 are not limited herein. FIG. 3A is a schematic diagram showing a magnetic flux inducer unit and an antenna of an electronic device in the third embodiment. Please refer to FIG. 3A, in the embodiment, the pillar 344 of the magnetic flux inducer unit 340 extends from the position close to the edge of the board 342 and contacts with the position of the antenna 330 far away from the central of the antenna 330.

Figure 3B:
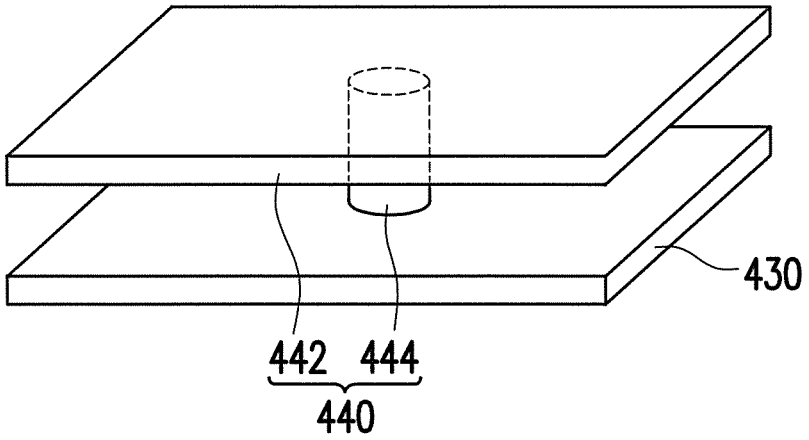
FIG. 3B is a schematic diagram showing a magnetic flux inducer unit and an antenna of an electronic device in the fourth embodiment.

FIG. 3B is a schematic diagram showing a magnetic flux inducer unit and an antenna of an electronic device in the fourth embodiment. Please refer to FIG. 3B, the main difference between the magnetic flux inducer unit 440 in FIG. 3B and the magnetic flux inducer unit 140 in FIG. 1 is that in the embodiment of FIG. 1, the pillar 144 of the magnetic flux inducer unit 140 extends from the position close to the edge of the board 142, and the magnetic flux inducer unit 140 is L-shaped viewed from the side. In the embodiment of FIG. 3B, the pillar 444 of the magnetic flux inducer unit 440 extends from the central position close to the board 442, and the magnetic flux inducer unit 440 is T-shaped viewed from the side. The shape of the magnetic flux inducer unit 440 and the relative positions of the magnetic flux inducer unit 440 and the antenna 430 vary according to the physical space in the electronic device, as long as the external magnetic flux is induced to the antenna 430.

In conclusion, the electronic device induces the external magnetic flux to the antenna in the electronic device by disposing the magnetic flux inducer unit between the original nonmetal covered portion of the metal cover (such as the hole of a camera lens or the hole of a logo) and the antenna, or disposing the magnetic flux inducer unit between the nonmetal frame close to the metal cover and the antenna, so as to overcome the shielding effect to the antenna, which makes the electronic device have the complete metal cover and keeps a good product appearance.

Although the invention has been disclosed with reference to certain preferred embodiments thereof, the disclosure is not for limiting the scope. Persons having ordinary skill in the art may make various modifications and changes without departing from the spirit and the scope of the invention. Therefore, the scope of the appended claims should not be limited to the description of the preferred embodiments described above.

What is claimed is:

1. An electronic device, comprising:

a main body including a nonmetal covered portion;

a metal cover disposed at the main body;

an antenna disposed in the main body; and a magnetic flux inducer unit disposed in the main body and located between the nonmetal covered portion and the antenna, wherein the magnetic permeability of the magnetic flux inducer unit is greater than 1.

2. The electronic device according to claim 1, wherein the nonmetal covered portion is disposed at the metal cover.

3. The electronic device according to claim 2, wherein the position of the nonmetal covered portion is the position of a camera lens or a logo.

4. The electronic device according to claim 1, wherein the antenna is a near field antenna.

5. The electronic device according to claim 1, wherein the projection of the nonmetal covered portion towards the magnetic flux inducer unit does not overlap the projection of the antenna towards the magnetic flux inducer unit.

6. The electronic device according to claim 1, wherein the magnetic flux inducer unit contacts with the antenna.

7. The electronic device according to claim 1, wherein the magnetic flux inducer unit includes a board and a pillar extending from the board.

8. The electronic device according to claim 1, wherein the main body includes a first side and a second side adjacent to each other, and the metal cover is disposed at the first side.

9. The electronic device according to claim 8, wherein the electronic device further includes:

a nonmetal frame disposed at the second side, wherein the magnetic flux inducer unit is disposed between the nonmetal frame and the antenna.

* * * * *